US005405085A

United States Patent [19]

White

[11] Patent Number: 5,405,085

[45] Date of Patent: Apr. 11, 1995

[54] TUNEABLE HIGH VELOCITY THERMAL SPRAY GUN

[76] Inventor: Randall R. White, 105 Pecan Dr., Kennedale, Tex. 76060

[21] Appl. No.: 7,264

[22] Filed: Jan. 21, 1993

[51] Int. Cl.[6] ..... B05B 7/20

[52] U.S. Cl. ..... 239/13; 239/8; 239/79

[58] Field of Search ..... 239/132, 133, 135, 79, 239/89, 85, 8, 13, 428; 447/446

[56] References Cited

U.S. PATENT DOCUMENTS

| | | |
|---|---|---|
| 2,804,337 | 8/1957 | Marantz . |
| 2,861,900 | 11/1958 | Smith et al. . |
| 2,950,867 | 8/1960 | Hawley et al. . |
| 2,960,594 | 11/1960 | Thorpe . |
| 2,990,653 | 7/1961 | Browning . |
| 3,030,982 | 4/1962 | Navara . |
| 3,055,591 | 9/1962 | Shepard . |
| 3,062,451 | 11/1962 | Keohane, Jr. . |
| 3,088,854 | 5/1963 | Spies, Jr. . |
| 3,111,267 | 11/1963 | Shepard et al. . |
| 3,112,072 | 11/1963 | Malone . |
| 3,129,889 | 4/1964 | Cape . |
| 3,131,091 | 4/1964 | Jones . |
| 3,136,484 | 6/1964 | Dittrich . |
| 3,150,828 | 9/1964 | Pelton et al. . |
| 3,393,871 | 7/1968 | Kudelka . |
| 3,545,906 | 12/1970 | Meneret et al. . |
| 3,801,346 | 4/1974 | Melton, Jr. et al. . |
| 3,884,415 | 5/1975 | Zverev et al. . |
| 4,004,735 | 1/1977 | Zevrev et al. . |

(List continued on next page.)

OTHER PUBLICATIONS

A Pragmatic Analysis and Comparison of HVOF Processes, Hobart Tafa Technologies, Inc., Horst J. Richter, 1992.

HEXOLOY, The Carborundum Company, "SIC Ceramic Materials for Design of H. P. Applic".

Hobart Tafa Technologies brochure, "New H.P. System Produces Superior Coating".

Hobart Tafa Technologies brochure, "What HVOF spraying is all about".

Hobart Tafa Technologies brochure, "A New HVOF Provides Superior Coatings".

Flame Spraying Tips, Part Three, The Browning Companies.

Flame Spraying Tips, Part Four, The Browning Companies.

*Primary Examiner*—Andres Kashnikow
*Assistant Examiner*—Christopher G. Trainor
*Attorney, Agent, or Firm*—James E. Bradley; Mark W. Handley

[57] ABSTRACT

A method and apparatus for thermal spraying a coating onto a substrate is provided wherein a coating material is transported within a high energy flow stream. A high energy flow stream, which includes the coating material, is generated within the thermal spray gun. A flow nozzle having a barrel directs the high energy flow stream towards the substrate. The flow nozzle includes a thermal transfer member for absorbing a heat flow from a first portion of the high energy flow stream, and transferring the heat flow back to a second portion of the high energy flow stream. Additionally, the thermal member provides a thermal barrier for retaining heat within the high energy flow stream by absorbing and retaining sufficient heat within the thermal flow nozzle so that the temperature gradient between the high energy flow stream and the flow nozzle is reduced, which reduces the amount of heat transferred therebetween. Further, the flow nozzle thermal transfer member may be replaced with alternative thermal transfer members to allow tuning of the thermal spray gun for use with a wide variety of coating materials.

15 Claims, 5 Drawing Sheets

U.S. PATENT DOCUMENTS 4,031,268 6/1977 Fairbairn .
4,065,057 12/1977 Durmann .
4,173,305 11/1979 Blankenship .
4,192,460 3/1980 Matsuo .
4,258,091 3/1981 Dudko et al. .
4,343,605 8/1982 Browning .
4,358,053 11/1982 Ingham et al. .
4,370,538 1/1983 Browning .
4,411,935 10/1983 Anderson .
4,416,421 11/1983 Browning .
4,540,121 9/1985 Browning .
4,562,961 1/1986 Guenard et al. .
4,568,019 2/1986 Browning .
4,579,280 4/1986 von Ruhling .
4,593,856 6/1986 Browning .
4,604,306 8/1986 Browning .
4,613,259 9/1986 Packer et al. .
4,616,779 10/1986 Serrano et al. .
4,619,845 10/1986 Ayers et al. .
4,626,476 12/1986 Londry et al. .
4,634,611 1/1987 Browning .
4,762,977 8/1988 Browning .
4,788,402 11/1988 Browning .
4,836,447 6/1989 Browning .
4,836,448 6/1989 Spaulding et al. .
4,869,936 9/1989 Moskowitz et al. .
4,871,114 10/1989 Kenderi .
4,911,363 3/1990 Webber .
4,925,103 5/1990 Muench et al. .
4,934,595 6/1990 Reimer .
4,958,767 9/1990 Labrot et al. .
4,960,458 10/1990 Browning .
5,005,764 4/1991 Simm et al. .
5,014,915 5/1991 Simm et al. .
5,014,916 5/1991 Trapani et al. .
5,047,265 9/1991 Simm et al. .
5,052,619 10/1991 Ulyanitsky et al. .
5,082,179 1/1992 Simm et al. ..... 239/80
5,120,582 6/1992 Browning .
5,135,166 8/1992 Dietiker et al. ..... 239/85
5,141,155 8/1992 Jacobsen ..... 239/135
5,285,967 2/1994 Weidman ..... 239/85

TUNEABLE HIGH VELOCITY THERMAL SPRAY GUN

BACKGROUND OF THE INVENTION

1. Field of the Invention

This invention relates in general to thermal spray guns used for thermal spraying a substrate with a coating applied in a high velocity flow stream.

2. Description of the Prior Art

Thermal spray guns are used in processes for thermal spraying substrates with coatings transported in high energy flow streams. Thermal spraying has also been known as flame spraying, metalization, high velocity oxy-fuel thermal spraying (H.V.O.F.), and high velocity air-fuel thermal spraying (H.V.A.F.). Coating materials are typically metals, ceramics, or cermet types of materials. The high energy flow streams typically include a carrier gas for propelling and transporting the coating material to a substrate target at high velocities. The coating material may be transported at supersonic velocities, often several times the speed of sound. In fact, some thermal spray guns and thermal spray processes determine proper operation of the gun by counting the number of shock diamonds appearing in the gas jet formed by the high energy flow stream exiting the gun.

Coatings applied by thermal spraying are thought to adhere to a substrate primarily by mechanical adhesion resulting from coating particles colliding with the surface of a substrate at high velocities. It is also theorized that bombarding a substrate with high velocity coating particles results in some of the kinetic energy of the coating particles being converted to heat when the coating particles impact with the substrate. This heat from converted kinetic energy is believed to aid in bonding the coating material to the substrate.

A thermal spray carrier gas is typically provided by a high velocity flame-jet resulting from combustion of a fuel which releases heat and generates a high temperature pressurized gas, which is the carrier gas. Thermal spray guns typically utilize combustion components, or reactants, such as oxygen and propane, oxygen and hydrogen, oxygen and kerosene, and kerosene and air. A fuel and an oxygen source are injected into a combustion chamber where they react in a combustion reaction under pressure and temperature to generate the high temperature pressurized gas, which is directed from the combustion chamber and into a high velocity flow stream. Coating materials, such as metals, ceramics, or cermets, are inserted into the flow stream. The high temperature pressurized gas is directed from the combustion chamber and down a flow nozzle to propel the coating material particles into a targeted substrate. Often, several shock diamonds appear in the high velocity flow stream exiting the thermal spray gun to indicate that the high temperature pressurized gas is travelling towards the targeted substrate at several times the speed of sound.

An example of a thermal spray gun is disclosed in U.S. Pat. No. 4,343,605, invented by James A. Browning, and issued Aug. 10, 1982. Additionally, several other Browning patents disclose further advances in thermal spray guns, such as:

U.S. Pat. No. 4,370,538, issued Jan. 25, 1983;
U.S. Pat. No. 4,416,421, issued Nov. 22, 1983;
U.S. Pat. No. 4,540,121, issued Sep. 10, 1985;

U.S. Pat. No. 4,568,019, issued Feb. 4, 1986;
U.S. Pat. No. 4,593,856, issued Jun. 10, 1986;
U.S. Pat. No. 4,604,306, issued Aug. 5, 1986;
U.S. Pat. No. 4,634,611, issued Jan. 6, 1987;
U.S. Pat. No. 4,762,977, issued Aug. 9, 1988;
U.S. Pat. No. 4,788,402, issued Nov. 29, 1988;
U.S. Pat. No. 4,836,447, issued Jun. 6, 1989; and
U.S. Pat. No. 4,960,458, issued Oct. 2, 1990.

The above referred U.S. Patents, including U.S. Pat. No. 4,343,605, are hereby incorporated by reference as if fully set forth herein.

An example of a Browning thermal spray gun is the Browning H.V.A.F. Model 250 Thermal Spray Gun, or the smaller Browning H.V.A.F. Model 150 Thermal Spray Gun. These thermal spray guns pass combustion air about the exterior of a flow nozzle to both cool the flow nozzle, and preheat the combustion air. Preheating the combustion air by passing it along the flow nozzle and within a combustion chamber housing prevents some of the heat loss experienced in some prior art thermal spray guns having liquid cooling systems. However, preheating combustion air by passing it along the flow nozzle cools the flow nozzle to temperatures well below the high energy flow stream, which results in drawing off excessive thermal energy from the high energy flow stream. Often, prior art thermal spray guns carry off heat from flow nozzles by cooling with either a coolant liquid, forced air, or ambient air passing about the nozzle by convection, all of which carry off heat transferred to the flow nozzle from the flow stream. Excessive cooling results in reduced deposit efficiencies.

Testing with the Browning Model 250 yielded a coating deposit efficiency of approximately 20% when using a Union Carbide Number 4890-1 coating material of 88% tungsten carbide with a 12% cobalt matrix, which has a particle size between 10 to 45 microns and the 12% cobalt added as a binder. A 20% coating deposit efficiency means that of 10 pounds of coating material applied to a targeted substrate, only 2 pounds were found to adhere to the substrate.

Although most thermal spray guns include some fine tuning capabilities for controlling the thermal spray process by adjusting the fuel and combustion air flow rate into the thermal spray gun, still only a narrow band width of particle sizes can be effectively sprayed with these thermal spray guns. For example, tests have shown that the Browning Model 250 and Model 150 can only be effectively utilized to apply coating materials having particle sizes of in the range between 10 to 45 microns. When particles approach sizes larger than 45 microns, the deposit efficiency is reduced even lower than 20% when using kerosene as a fuel. It should be noted that if larger particle sizes could be used, particles propelled towards a target at a specific velocity would have an additional amount of kinetic energy over that of a smaller particle size, resulting in conversion of the additional kinetic energy into additional thermal heat upon impact with the targeted substrate.

SUMMARY OF THE INVENTION

It is one objective of the present invention to provide a method and apparatus for thermal spraying a targeted substrate with a coating, wherein a thermal spray flow stream exits the thermal spray apparatus having a more uniform temperature across a cross section of the thermal spray flow stream.

It is another objective of the present invention to provide a method and apparatus for thermal spraying a substrate with a coating, wherein a thermal flow nozzle transfers heat into at least a portion of a thermal spray flow stream.

It is yet another objective of the present invention to provide a method and apparatus for thermal spraying a substrate with a coating, wherein a thermal flow nozzle absorbs a heat flow from a first portion of a thermal spray flow stream, and then transfers the heat flow to a second portion of the thermal spray flow stream.

It is still another objective of the present invention to provide a method and apparatus for thermal spraying a substrate with a coating, wherein a thermal flow nozzle provides a thermal barrier for retaining heat within a high velocity thermal spray flow stream by absorbing heat from the thermal spray flow stream to increase the temperature of the nozzle, reducing the temperature gradient between the flow nozzle and the thermal spray flow stream in order to reduce the rate of heat loss flowing from the thermal spray flow stream to the flow nozzle.

These objectives are achieved as is now described. A method and apparatus for thermal spraying a coating onto a substrate is provided wherein a coating material is transported within a high energy flow stream. The high energy flow stream, which includes the coating material, is generated within the thermal spray gun. A flow nozzle having a barrel directs the high energy flow stream towards the substrate. The flow nozzle includes a thermal transfer member for absorbing a heat flow from a first portion of the high energy flow stream, and transferring the heat flow back to a second portion of the high energy flow stream. Additionally, the thermal member provides a thermal barrier for retaining heat within the high energy flow stream by absorbing and retaining sufficient heat within the thermal flow nozzle so that the temperature gradient between the high energy flow stream and the flow nozzle is reduced, which reduces the amount of heat transferred therebetween. Further, the flow nozzle thermal transfer member may be replaced with alternative thermal transfer members to allow tuning of the thermal spray gun for use with a wide variety of coating materials.

Additional objects, features, and advantages will be apparent in the written description which follows:

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
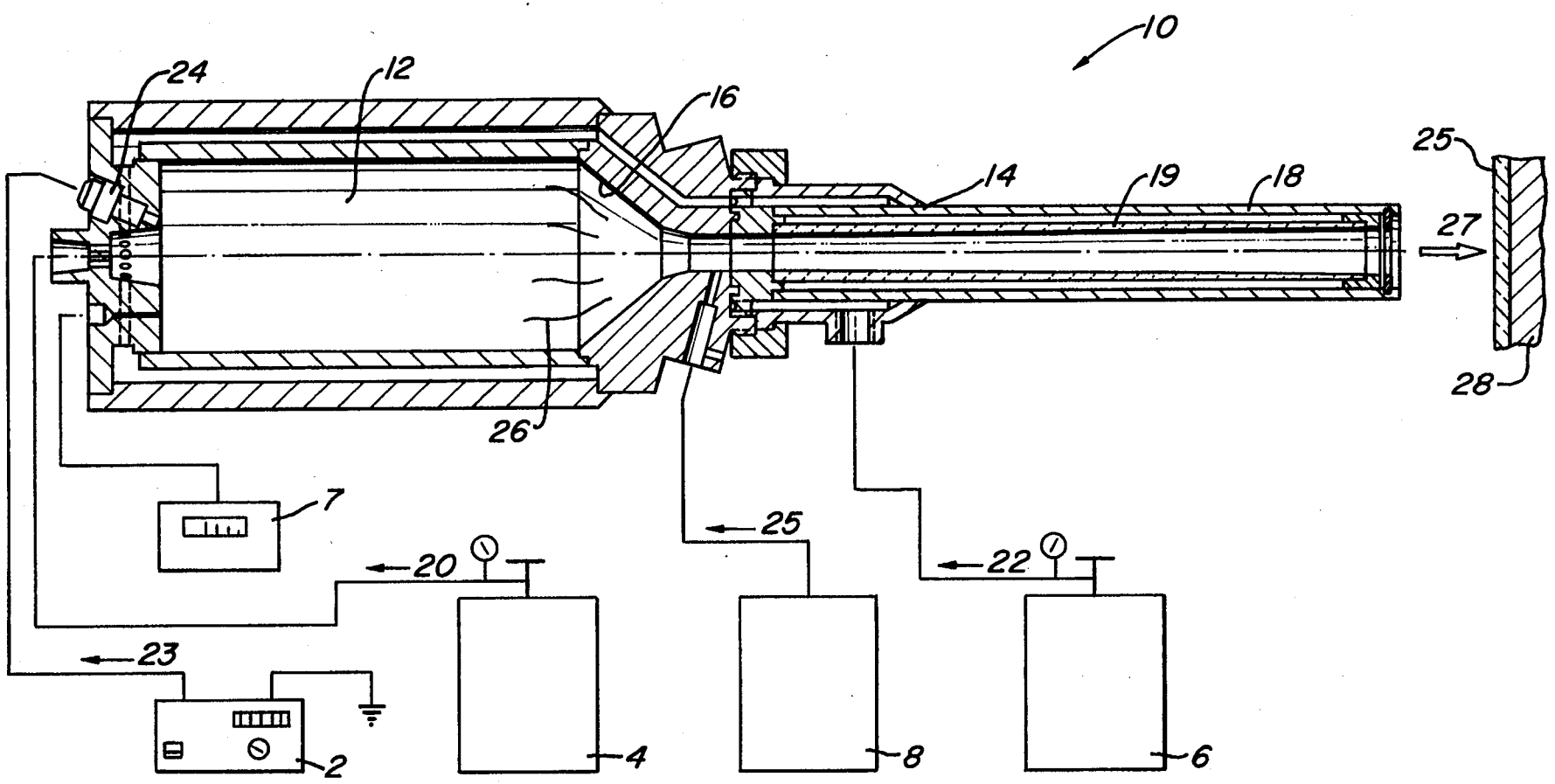
FIG. 1 is a schematic diagram depicting the thermal spray gun of the preferred embodiment of the present invention in a partial longitudinal section view in use within a system for coating a substrate.

With reference now to the figures, and in particular with reference to FIG. 1, a schematic diagram depicts a thermal spray system having power supply 2, fuel supply 4, air supply 6, pressure monitor 7, coating material source 8, and thermal spray gun 10 of the preferred embodiment of the present invention. Thermal spray gun 10 includes combustion chamber 12 and flow nozzle 14, which includes venturi 16 and barrel 18 having insert 19, which is a thermal transfer member. In the preferred embodiment of the present invention, although venturi 16 is a portion of flow nozzle 14, venturi 16 also provides an end for combustion chamber 12.

Fuel supply 4 contains fuel 20 for injection into combustion chamber 12 and mixing with air 22, which flows from air supply 6 into combustion chamber 12. It should be noted, however, that during startup oxygen (not shown) is utilized to initiate combustion within thermal spray gun 10, and then later air 22 is used as a less expensive oxygen source for combustion of fuel 20. Additionally, power supply 2 provides electrical power 23 to spark plug 24 to initiate combustion. After combustion is initiated, electrical power 23 is no longer applied to spark plug 24.

Coating material source 8 contains coating material 25 which is injected at venturi 16 into high temperature gas 26 generated by combustion of fuel 20 within combustion chamber 12. High energy flow stream 27 is formed by coating material 25 and high temperature pressurized gas 26. Flow nozzle 14 directs high energy flow stream 27 from thermal spray gun 10 towards targeted substrate 28.

In the preferred embodiment of the present invention, combustion chamber 12 is a modified Browning H.V.A.F. Model 250 thermal spray gun, modified to have a different cross-sectional diameter for venturi 16 so that a smooth flow transition is provided from combustion chamber 12 into barrel 18 and insert 19. Flow nozzle 14 of the preferred embodiment of the present invention is different from that used in a Browning H.V.A.F. Model 250 thermal spray gun.

Figure 2:
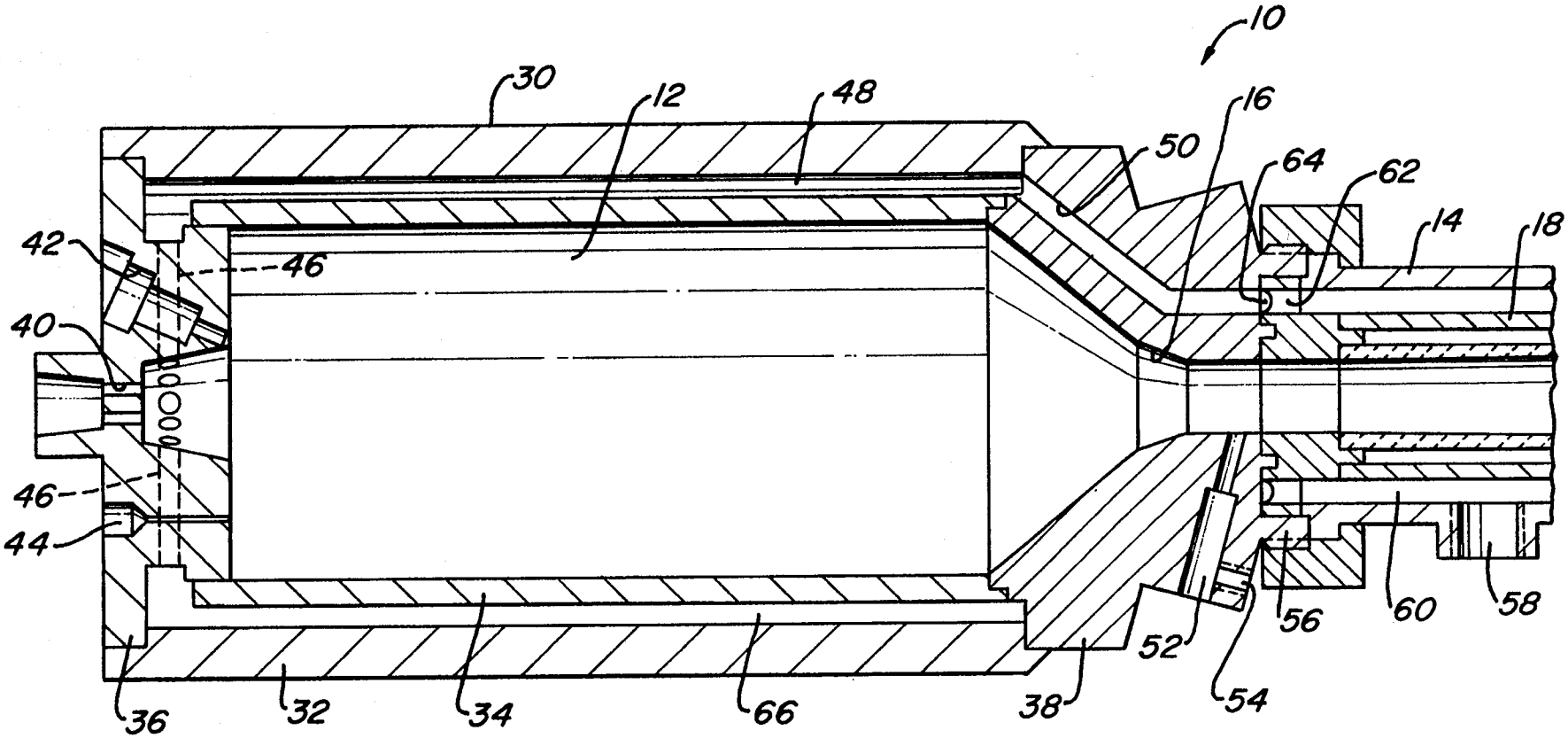
FIG. 2 is a longitudinal section view depicting the combustion chamber of the thermal spray gun of the preferred embodiment of the present invention.

Referring now to FIG. 2, a longitudinal section view of thermal spray gun 10 of the preferred embodiment of the present invention depicts combustion chamber housing 30. Combustion chamber housing 30 includes outer sleeve 32, inner sleeve 34, mixture feed plug 36, and end adapter 38. Combustion chamber 12 is defined by the interior portions of inner sleeve 34, mixture feed plug 36, and end adapter 38. Inner sleeve 34 is disposed concentrically within outer sleeve 32.

Mixture feed plug 36 includes fuel feed ports 40, of which two of the four included in the preferred embodiment of the present invention are shown. Mixture feed plug 36 further includes spark plug port 42 for receipt of spark plug 24 (not shown in FIG. 2). Pressure monitoring port 44 is provided to allow monitoring of pressure within combustion chamber 12. Multiple air intake ports 46, two of which are shown in phantom in FIG. 2, are spaced circumferentially around and pass radially through mixture feed plug 36.

Inner sleeve 34 is positioned concentrically within outer sleeve 32. Housing annular space 48 is defined between inner sleeve 34 and outer sleeve 32. End adapter 38 includes sixteen air flow ports 50, one of which is shown in FIG. 2, spaced circumferentially around a central axis of thermal spray gun 10. Material injection ports 52 pass radially into end adapter 38 to provide a pathway for injection of coating material 8 (not shown in FIG. 2) into thermal spray gun 10. In the preferred embodiment of the present invention, two of the four material injection ports 52 supplied on the Browning H.V.A.F. Model 250 were utilized. Set screw hole 54 is provided to retain a coating material injector within material injection port 52.

End adapter 38 further includes threaded shoulder 56 for securing barrel 18 of flow nozzle 14 to combustion chamber housing 30. Flow nozzle 14 includes air supply port 58 connected to annular space 60, which is circumferentially continuous around an end portion of barrel 18. Air flow ports 62 interconnect between annular space 60 and groove 64, which is circumferentially continuous around an end-face of a portion of flow nozzle 14.

Air flow path 66 is formed by air supply port 58, annular space 60, air flow ports 62, groove 64, air flow ports 50, housing annular space 48, and air intake ports 46 (two of which are depicted in phantom in FIG. 2). Air flow path 66 provides a passageway for passing air 22, or oxygen during startup, from air supply 6 into combustion chamber 12.

Figure 3:
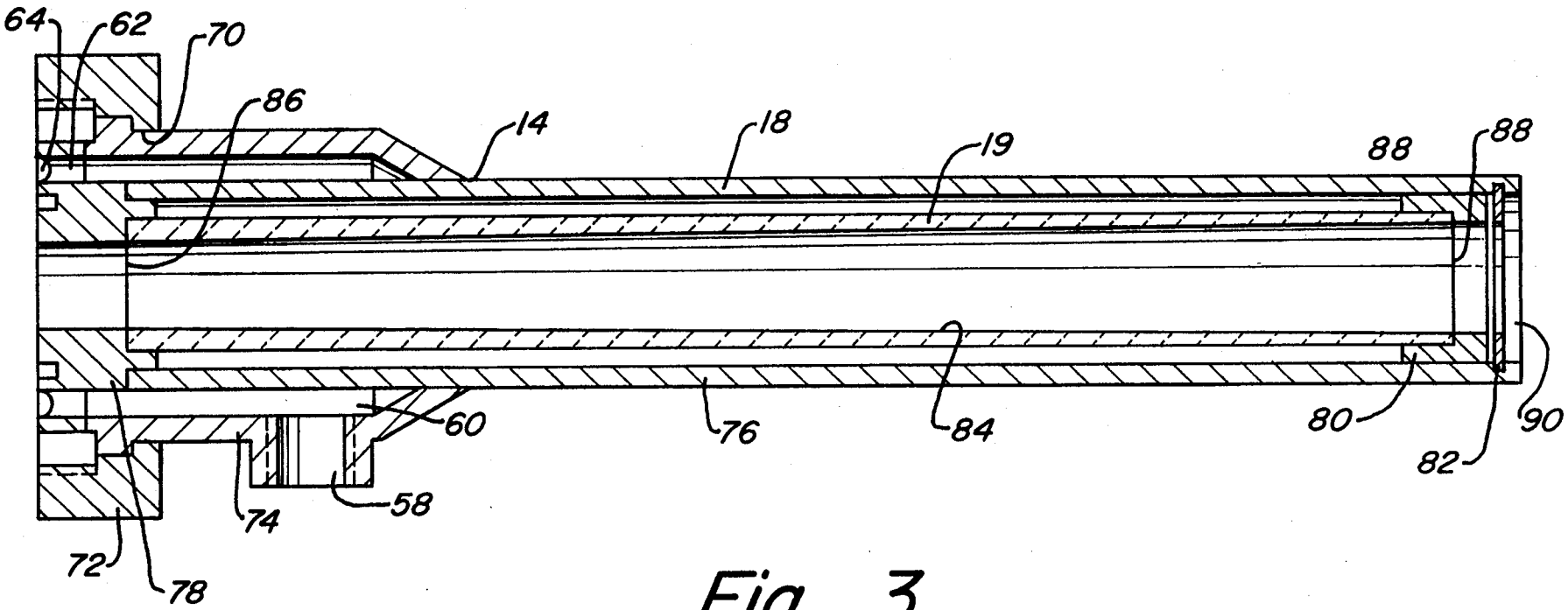
FIG. 3 is a longitudinal section view depicting a portion of the flow nozzle of the thermal spray gun of the preferred embodiment of the present invention.

Now referring to FIG. 3, a longitudinal section view depicts a portion of flow nozzle 14 of thermal spray gun 10 of the preferred embodiment of the present invention. Flow nozzle 14 includes nozzle coupling 70 which releasably secures barrel 18 to combustion chamber housing 30 (not shown in FIG. 3). Nozzle coupling 70 includes threaded ring 72 which threadingly engages with threaded shoulder 56 (shown in FIG. 2). Still referring to FIG. 3, nozzle coupling 70 further includes coupling sleeve 74, which circumferentially surrounds an end of barrel 18 and forms annular space 60 therebetween. Coupling sleeve 74 includes air supply port 58 which is threaded for receipt of an air supply line. A portion of coupling sleeve 74 abuts a portion of threaded ring 72 when barrel 18 is secured to combustion chamber housing 30 (not shown in FIG. 3).

Barrel 18 of flow nozzle 14 includes insert 19, sleeve 76, spacer 78, insert spacer 80, and snap ring 82. In the preferred embodiment of the present invention spacer 78 is welded to sleeve 76. Air flow ports 62 are circumferentially spaced around a central axis of spacer 78, and extend radially through spacer 78 to provide a portion of air flow path 66 (shown in FIG. 2). Groove 64 is circumferentially cut into an end face of spacer 78 to provide a continuous flow path connecting air flow ports 62 together, and to connect air flow ports 62 with air flow ports 50 (shown in FIG. 2).

Still referring to FIG. 3, spacer 78 and insert spacer 80 retain insert 19 concentrically aligned within sleeve 76. Snap ring 82 retains insert 19 and insert spacer 80 within sleeve 76. In the preferred embodiment of the present invention, insert 19 is formed of a silicon carbide having the ability to withstand high thermal shock, such as HEXOLOY® grade SA sintered silicon carbide available from the Carbordundun Company in Niagara Falls, N.Y. HEXOLOY® grade SA has a high thermal shock resistance, having a lower coefficient of thermal expansion and a higher thermal conductivity than most other high temperature materials. The remainder of barrel 18, along with nozzle coupling 70, is formed of a high temperature stainless steel, such as, for example, 310, 330, or 333 stainless steel.

Adequate clearance is required between the components of flow nozzle 14 to insure adequate room for thermal expansion during operation. For example, in one alternative embodiment of the present invention, a cumulative longitudinal clearance between insert 19, insert spacer 80, and snap ring 82 of about one-sixteenth (1/16) of an inch, and a cumulative diametrical clearance between spacer 78, insert spacer 80, and insert 19 of about one thirty-seconds (1/32) of an inch were found to be adequate to allow thermal expansion of insert 19 within barrel 18 without fracturing.

Insert 19 provides a thermal transfer member for the preferred embodiment of the present invention, having a longitudinal length in the range of from two (2) to fourteen (14) inches, depending on the coating materials and parameters under which thermal spray gun 10 is operated. For example, a length of around eight (8) inches should provide an adequate length for thermal spraying a coating of Union Carbide's material number 489-1, which is agglomerated and sintered material of 88% tungsten carbide and 12% cobalt. In the preferred embodiment, insert 19 has an exterior diameter of roughly three-quarters ($\frac{3}{4}$) of an inch, such as, for example, an exterior diameter of eleven-sixteenths (11/16) of an inch for a twelve (12) inches long insert 19.

Insert 19 includes central bore 84, which extends from entrance 86 to exit 88. Central bore 84 provides an interior surface having a taper ranging from one-thirty-second (1/32) to one-quarter ($\frac{1}{4}$) inch in diameter per foot of longitudinal length, running from entrance 86 to exit 88. A diametrical taper of one-quarter ($\frac{1}{4}$) inch per foot results in exit 88 having a larger diameter than entrance 86, the difference between exit 88 diameter and entrance 86 diameter being equal to one-quarter ($\frac{1}{4}$) of an inch times the longitudinal length in feet of insert Barrel 18 also includes nozzle discharge 90 of flow nozzle 14.

In the preferred embodiment of the present invention, central bore 84 has a different diametrical taper depending upon the coating material being thermal sprayed with thermal gun 10. For example, using Union Carbide material Number 489-1, which is an agglomerated sintered coating material having 88% tungsten carbide and 12% cobalt as a binder, and a particle size ranging from 10 micron to 45 micron, a taper for central bore 84 ranging from one-eighth ($\frac{1}{8}$) of an inch to one-quarter ($\frac{1}{4}$) inch per foot should provide optimal performance. For a coating material of Union Carbide Material Number NI 185, which is a 95% nickel and 5% aluminum material having a particle size ranging from 45 micron to 90 micron, a taper ranging in size from one-sixteenth (1/16) of an inch to one-eighth ($\frac{1}{8}$) of an inch taper per foot should provide an optimum deposit efficiency.

For thermal spraying other coating materials through a silicon carbide insert 19, or for thermal spraying various coating materials through barrels made of different materials other than silicon carbide, other dimensions and tapers for central bore 84 may be found to provide optimum deposit efficiencies. From tests showing the preceding results, the following generalizations may be made. For a material having a larger particle size, the smaller the taper for optimizing thermal spray coating parameters. For a thermal spray gun supplying a lesser heat rate than another, the smaller the taper required to optimize thermal spray coating parameters. Additionally, the longer the barrel, the higher the temperature to which the cooling material is heated. Prototype testing has indicated that a nozzle having a diametrical taper between one-thirty-seconds (1/32) of an inch and one-quarter (¼) of an inch yields optimum thermal spray coating parameters.

Different barrel geometries may be used as a course tuning for thermal spray gun 10 to enable the thermal spraying of a wider range of particles having different particle sizes and different thermal masses. In fact, interchangeable barrels may be releasably secured to combustion chamber housing 30 by means of a nozzle coupling such as nozzle coupling 70. The combustion pressure within combustion chamber 12 may be varied to achieve a fine tuning for achieving optimum deposit efficiencies.

Figure 4A:
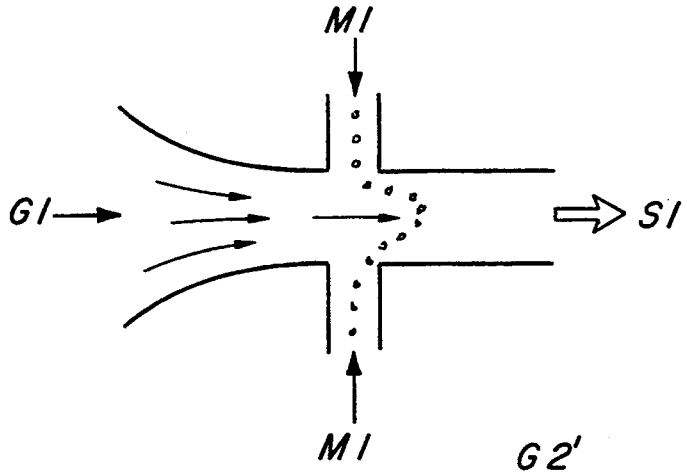
FIGS. 4*a* through 4*d* are schematic diagrams depicting a few of the various means for inserting a coating material into a high velocity gas flow stream to form the high energy flow stream of the preferred embodiment of the present invention.

With reference to FIG. 1, and FIGS. 4*a* through 4*d*, several schematic diagrams depict just a few of the various means for inserting coating material 25 into high pressure temperature pressurized gas 26 to form high energy flow stream 27 of the present invention. FIG. 4*a* depicts a coating material M1 being radially injected into high temperature pressurized gas G1 flowing through a venturi section to form high energy flow stream S1, which is similar to venturi 16 in flow nozzle 14 and material injection ports 52 of the preferred embodiment of the present invention (not shown in FIG. 4*a*).

Figure 4B:
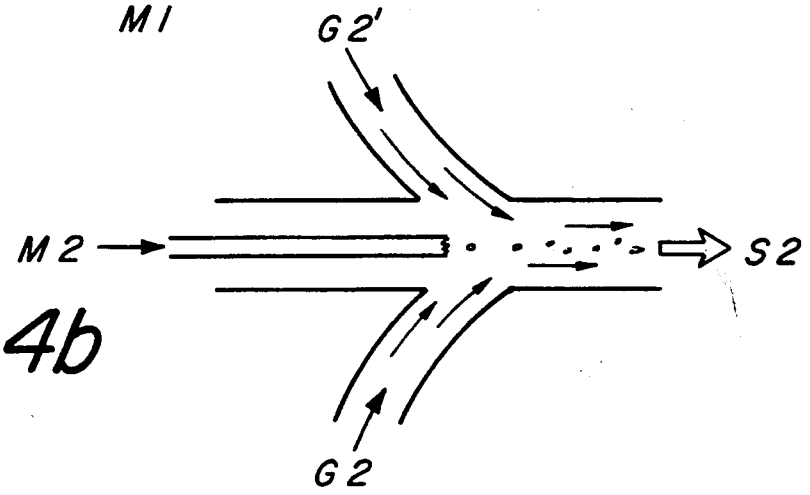

FIG. 4*b* depicts coating material M2 being inserted into converging flow streams of high temperature pressurized gas G2 and G2' to form high energy flow stream S2.

Figure 4C:
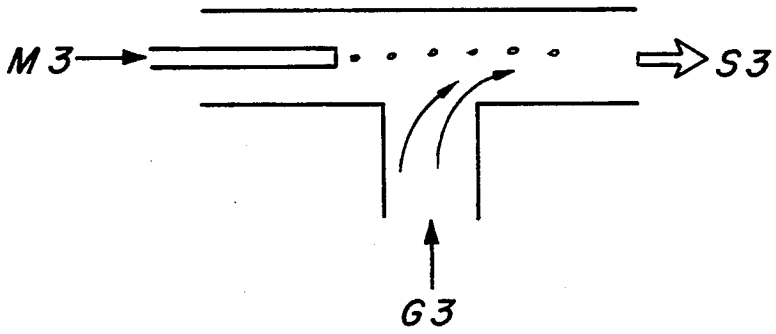

FIG. 4*c* depicts coating material M3 being inserted into a radially injected flow stream of high temperature pressurized gas G3 to form high energy flow stream S3.

Figure 4D:
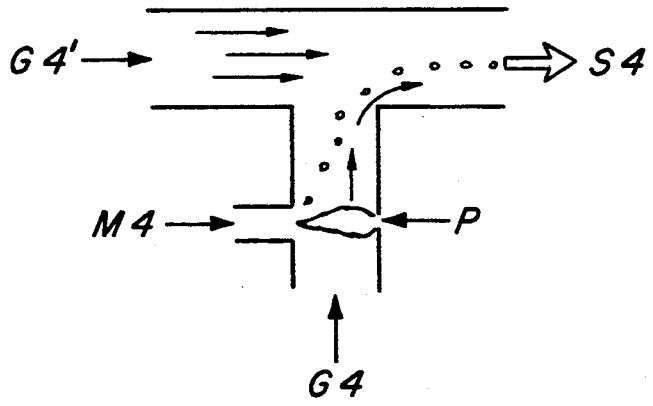

In FIG. 4*d* a relatively lower velocity flow stream of gas G4 is shown passing across plasma arc torch P and mixing with coating material M4. The flow stream of gas G4 and material M4 then mix with a high velocity flow stream of gas G4' to form high energy flow stream S4. The high velocity flow stream G4' imparts momentum to the flow stream of gas G4 and coating material M4, providing high velocities for high energy flow stream S4.

Operation of thermal spray gun 10 is now described. Referring to FIG. 1, fuel 20 from fuel supply 4 is injected into combustion chamber 12. Air 22 from air supply 6 is passed through air flow path 66, which is shown in FIG. 2, and into combustion chamber 12. Still referring to FIG. 1, to initiate combustion, oxygen (not shown) is first injected into combustion chamber 12 rather than air 22. Power supply 2 provides electrical power 23 to spark plug 24 to initiate combustion. Once combustion is initiated, power supply 2 no longer provides electrical power 23 to spark plug 24. After the temperature of thermal spray gun 10 is increased to a sufficient temperature for preheating air 22 to a high enough temperature to sustain combustion within combustion chamber 12, air 22 is used as an oxidizer for combustion of fuel 20 rather than more expensive oxygen (not shown).

Once combustion is initiated, it occurs continuously as fuel 20 is injected into combustion chamber 12 and mixed with air 22. Pressure monitor 7 is used to monitor the interior pressure of combustion chamber 12, and fuel supply 4 and air supply 6 are adjusted to supply a stoichemetric air-to-fuel ratio for efficient combustion. Fuel supply 4 and air supply 6 can be further adjusted to control the combustion pressure, which is the pressure within combustion chamber 12.

Combustion of fuel 20 generates a high temperature pressurized gas 26 which is directed from combustion chamber 12 by flow nozzle 14. Flow nozzle includes venturi 16 and barrel 18.

Coating material 25 from coating material source 8 is injected into thermal spray gun 10 at the smaller internal diameter of venturi 16. Coating material 25 then mixes with high temperature pressurized gas 26 to form high energy flow stream 27. High energy flow stream 27 is directed through barrel 18 and towards targeted substrate 28, and upon high velocity impact with substrate 28, coating material 25 bonds with the surface of substrate 28 to coat substrate 28.

In the preferred embodiment of the present invention, high energy flow stream 27 has a supersonic velocity yielding multiple shock diamonds upon exiting nozzle 14.

Combustion temperatures within combustion chamber 12 typically range from 2500 to 5000 degrees F., and, depending on the fuel being utilized, can run either above or below this range. It should be noted, however, that High Velocity Air-Fuel (H.V.A.F.) thermal spray guns typically operate at lower flame, or combustion, temperatures than High Velocity Oxy-Fuel (H.V.O.F.) thermal spray guns. Typically H.V.O.F. thermal spray guns utilize pure oxygen for an oxidizer in combustion of a fuel, such as, for example, acetylene. This lower flame, or combustion, temperature of H.V.A.F. thermal spray guns allows flow nozzles to be made from commercially available materials which may be operated at temperatures approaching the combustion flame temperature. For example, a Browning H.V.A.F. thermal spray gun, using kerosene and air, operates with a combustion flame temperature of approximately 3,300 degrees F. A prior art H.V.O.F. thermal spray gun utilizing acetylene and oxygen operates with a combustion flame temperature in excess of 5,000 degrees F.

Since H.V.A.F. thermal spray guns are operated with combustion temperatures much closer to maximum allowable temperatures for materials from which barrels are made, these thermal spray guns can be operated with a smaller temperature difference between the combustion flame temperature than H.V.O.F. thermal guns can be operated. The smaller the difference between the combustion flame temperature and the flow nozzle interior surface temperature, the smaller the net heat loss from the high energy flow stream, and thus the more heat retained within the flowstream. So with current commercially available materials, an H.V.A.F. thermal spray gun mean nozzle surface temperatures can approach much closer to flowstream temperatures than can they with H.V.O.F. thermal spray gun nozzle surface temperatures, retaining more heat within high energy flowstream 27.

In the preferred embodiment, thermal spray gun 10 is an H.V.A.F. thermal spray gun. Referring to FIG. 3, in the preferred embodiment of the present invention, flow nozzle 14 includes barrel 18 having insert 19, which has a central bore 84 operating at a minimum median surface temperature in excess of fifteen hundred (1500) degrees F., and optimally operating in excess of twenty-two hundred (2200) degrees F. The velocity of the high energy flow stream exiting nozzle 18 can be several times the speed of sound.

Figure 5:
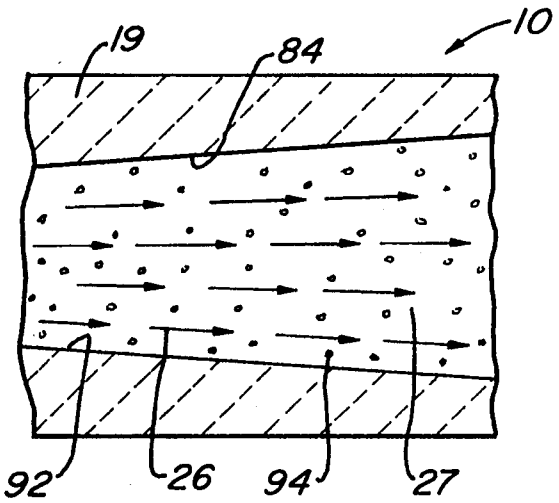
FIG. 5 is a schematic diagram depicting the high energy flow stream passing through a portion of the flow nozzle of the thermal spray gun of the preferred embodiment of the present invention.

With reference to FIG. 5, a schematic diagram depicts high energy flow stream 27 passing through a portion of interiorly tapered insert 19 of flow nozzle 14. As high temperature pressurized gas 26, which may be considered a first portion of high energy flow stream 27, passes through insert 19, it transfers heat to surface 92 of central bore 84. Once surface 92 of central bore 84 is heated to a temperature higher than a portion 94 of coating material 25 flowing within high energy flow stream 27, which may be considered a second portion 94 of the high energy flow stream 27, a heat flow is transferred from barrel 18 to portion 94 of coating material 25.

Radiant heat transfer is thought to be the primary mechanism for transferring the heat flow from barrel 18 to portion 94 of coating material 25. However, heat is also transferred to portion 94 of coating material 25 from high temperature pressurized gas 26 which remains at a higher temperature than it would if surface 92 of central bore 84 were not heated to temperatures approaching the temperature of high temperature pressurized gas 26. So higher temperatures of surface 92 of central bore 84 not only radiantly transfers heat to portion 94 of coating material 25, but also provides a thermal barrier for retaining heat within high energy flow stream 27 which retains high temperature pressurized gas at higher temperatures for transferring a larger rate of heat flow to coating material 25 than if it were cooled to lower temperatures by transferring heat to insert 19 of barrel 18.

In the preferred embodiment of the present invention, this heat flow from surface 92 of central bore 84 of insert 19 to portion 94 of coating material 25 is provided by a portion of the heat flow from high temperature pressurized gas 26 to surface 92 of central bore 84. However, in alternative embodiments to the present invention, other means may be utilized for transferring heat to surface 92 of central bore 84 for providing a heat flow to portion 94 of coating material 25 within high energy flow stream 27.

A resulting benefit of the heat flow transferred from the surface of central bore 84 to portion 94 of coating material 25 passing through barrel 18 is that the temperature of the particles of coating material 25 within high energy flow stream 27 at nozzle discharge 90 (not shown in FIG. 5) will be more uniform. In the preferred embodiment of the present invention, for an adequate heat flow to provide a more uniform temperature of coating material 25 within flow stream 27, surface 92 of central bore 84 should be maintained at a minimum median temperature of in excess of fifteen hundred (1500) degrees F., and preferably a minimum median temperature in excess of twenty-two hundred (2200) degrees F.

Still referring to FIG. 5, in the preferred embodiment of the present invention, thermal transfer member 19 provides a thermal barrier for retaining heat within high energy flow stream 27. Whether thermal transfer member 19 absorbs heat from high energy flow stream 27, or from another source for thermal heating, the temperature of surface 92 of thermal transfer member 19 is increased. This increase in temperature of surface 92 reduces the temperature gradient, or differences in temperature, between surface 92 and high energy flow stream 27 at various portions of central bore 84 as high energy flow stream 27 passes through central bore 84.

The reduction in temperature gradient between high energy flow stream 27 and surface 92 provides a thermal barrier for preventing heat flow from flow stream 27 by reducing the amount of heat transferred from flow stream 27, through surface 92, to other heat sinks about thermal spray gun 10. By retaining more heat within high energy flow stream 27, the particles of coating material 25 exiting from thermal spray gun 10 within flow stream 27 are heated to higher and more uniform temperatures.

Referring back to FIG. 3, in the preferred embodiment of the present invention, most of the exterior of barrel 18 of flow nozzle 14 is cooled by ambient air (not shown) in the environment about barrel 18. In other embodiments of the present invention, which are not shown in the accompanying figures, a flow nozzle of the present invention may be cooled by passing a coolant fluid about the flow nozzle barrel, such as passing forced air, a coolant liquid, a gas, or incoming combustion air, as done with the prior art Browning H.V.A.F. Models 150 and 250 thermal spray guns.

When a flow nozzle of the present invention is cooled, either by ambient air, as in the preferred embodiment, or by use of a coolant fluid, the rate of cooling should be controlled to maintain the flow nozzle at temperatures high enough to maintain optimum thermal coating parameters. Referring back to FIG. 5, in the preferred embodiment of the present invention, temperatures high enough for maintaining optimum thermal coating parameters are maintained when the median temperature along the length of surface 92 is maintained at a minimum temperature of in excess of fifteen hundred (1500) degrees F., and preferably above twenty-two hundred (2200) degrees F. The closer the median temperature of surface 92 to the combustion flame temperature, and the temperature of high temperature gas 26, the less heat that will be lost from high energy flow stream 27.

Figure 6:
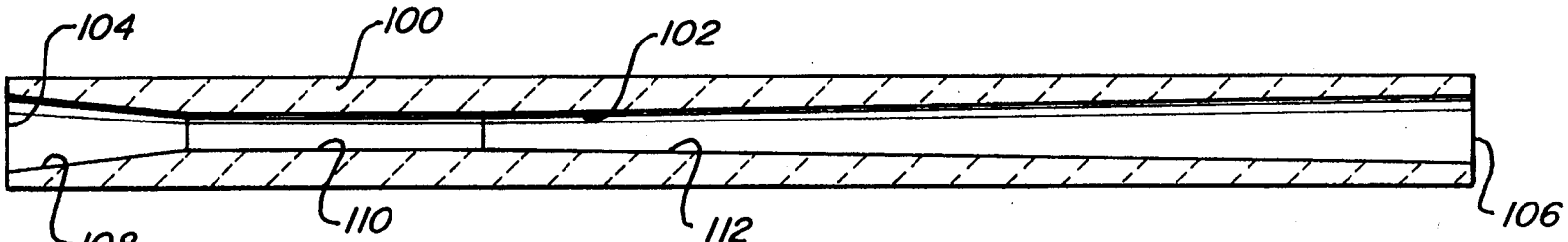
FIG. 6 is a longitudinal section view depicting a thermal transfer member of an alternative embodiment of the present invention.

Referring now to FIG. 6, in one alternative embodiment of the present invention, a prototype flow nozzle insert 100 is shown for use in place of insert 19 (not shown in FIG. 6) in a barrel similar to barrel 18 of flow nozzle 14 (not shown in FIG. 6). Insert 100 was constructed by machining a graphite tube, and then coating the graphite tube with silicon carbide, which is a ceramic material having thermal expansion properties similar to graphite. The silicon carbide coating of this alternative embodiment of the present invention is applied by a process initially patented by Texas Instruments Incorporated, and sold under a trade name of T.I. Coat, and also referenced under a trade name of M.T.C. Dura-Cote Silicon Carbide. The silicon carbide coating includes thicknesses greater than five-thousandths of an inch with zero porosity.

In this first alternative embodiment of the present invention, insert 100 has longitudinal length of about fourteen (14) inches, and an outside diameter of approximately one-point-two (1.2) inches. Shorter inserts similar to insert 100 were also tested, ranging in sizes from four (4) to fourteen (14) inches. Entrance diameter 104 is approximately seven-eighths ($\frac{7}{8}$) inch to match the interior diameter of the exit portion of venturi 16 which is defined by the interior of end adapter 38 (not shown in FIG. 6). Straight bore central section 110 has an interior diameter of one-half ($\frac{1}{2}$) inch. Tapered entrance section 108 provides a taper between entrance diameter 104 and straight bore section 110. Tapered exit section 112 has a diametrical taper which extends to nozzle exit 106. The longitudinal length of insert 100 has ranged between four (4) and fourteen (14) inches, with tapered exit section 112 drilled with a ten (10) inch long tapered mill. A length of eight (8) inches appears to provide best results for use with a Browning H.V.A.F. 250 spraying Union Carbide Material No. 489-1.

In another alternative embodiment of the present invention, second and third thermal spray gun prototypes were made from a Model 250 combustion chamber and flow nozzle barrels fitted with inserts made from two furnace nozzles. These inserts were made of a solid Carborundum Hexally® material, which is a dense silicon carbide. They were shaped similar to insert 100 shown in FIG. 6. Two furnace nozzles were utilized, both available from the Carborundum company, in Niagara Falls, N.Y. One having Carborundum Part No. 31320, which is referred to as "SA Nozzle Liner SSD-8 per drawing REC-8283D", which has a central bore internal diameter of central section 110 of one-half (½) inch. The other has Carborundum Part No. 31436, referred to as "SA Nozzle HEX-V7 per drawing REC8283D, and having a central bore internal diameter of central section 110 of seven-sixteenths (7/16) inch. Tests with the second and third prototype thermal spray guns of the present invention also yielded higher deposition efficiencies and superior coating qualities.

Figure 7:
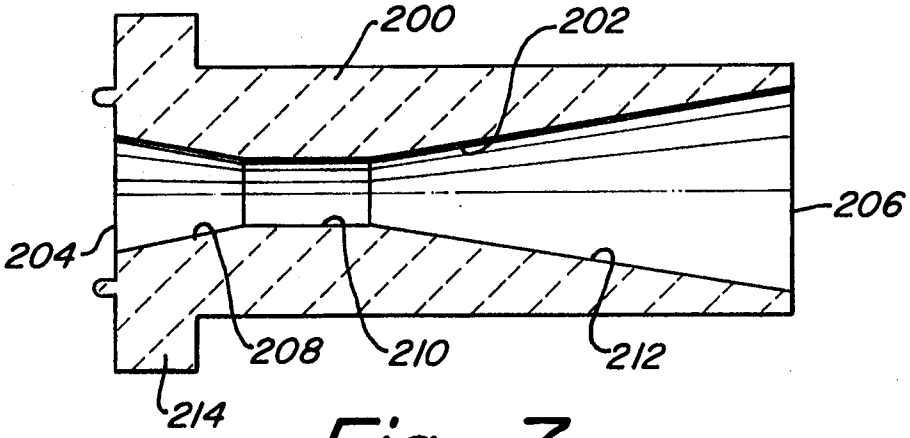
FIG. 7 is a longitudinal section view of another thermal transfer member of another alternative embodiment of the present invention.

Referring now to FIG. 7, in yet another alternative embodiment of the present invention, a fourth prototype flow nozzle was fabricated by making an entire flow nozzle barrel 200 from a machined graphite stock coated with silicon carbide, as was done to fabricate insert 100. Referring back to FIG. 3, barrel 200 in this fourth prototype flow nozzle replaced barrel 18 of the preferred embodiment of the present invention, forming both sleeve 76 and insert 19 as one solid piece secured to a Browning H.V.A.F. Model 250 combustion chamber by a nozzle coupling similar to nozzle coupling 70. Here again, this fourth prototype achieved high quality coating results similar to those for other embodiments of the present invention.

Still referring to FIG. 7, flow nozzle barrel 200 had a longitudinal length of approximately eight (8) inches, an smaller external diameter about the length of barrel 200 of about one (1) inch. A central bore 202 passed longitudinally through flow nozzle barrel 200, from an entrance 204 to an exit 206, having a tapered entrance section 208, a central section 210, and a tapered exit section 212.

Central section 210 had a diameter of roughly one-half (½) inch, and tapered entrance section 208 was sized to provide a smooth flow transition between the venturi on the Model 250 combustion chamber discharge and central section 210. Tapered exit section 212 had a diametrical taper of one-eighth (⅛) inch per foot. Shoulder 214 was provided for securing barrel 200 to the Model 250 combustion chamber, having a diameter of roughly one and one-quarter (1¼) inches, and a longitudinal length of roughly one inch.

In yet another alternative embodiment of the present invention, a Browning H.V.A.F. Model 150 was fitted with a fifth prototype barrel constructed of 310 stainless steel. The stainless steel barrel was generally cylindrical having an outside diameter of three-quarters (¾) inch, a longitudinal length of twelve (12) inches, and a straight central bore of three-eighths (⅜) inches, without a tapered section. High deposit efficiencies were obtained in thermal coating a substrate with Union Carbide Material Number 489-1 , which is an agglomerated and sintered material made of 88% tungsten carbide and a 12% cobalt binder, having a 10 to 45 micron particle sizes.

Insert 19 and barrel 18 of the present invention may also be formed of other ceramic materials in alternative embodiments of the present invention. For example, Diamondnite Products has a family of ceramic materials sold under the tradename ZAT® which may be used in high temperature service applications. Another example of an alternative ceramic material from which to construct insert 19 and barrel 18 is silicon nitrate.

Thermal spray guns of the present invention provide several advantages over prior art thermal spray guns. One advantage is greater uniformity in the temperature of different coating material particles in the high energy flow stream exiting a thermal spray gun of the present invention, which results in a much higher deposit efficiency in coating a targeted substrate. Additionally, with more uniform thermal spray discharge temperatures, the thermal spray coating achieved with the present invention is of a much greater quality, having less voids and discontinuities, and higher and more consistent coating hardness test values.

In tests with alternative embodiments of the present invention, deposit efficiencies in the range of 75% were achieved utilizing a Browning Model 250 combustion chamber fitted with barrels made of both solid silicon carbide, and graphite tubes coated with silicon carbide, having a interior barrel diametrical tapers ranging from one eighth (⅛) to one quarter (¼) inch per foot, spraying Union Carbide Material Number 489-1 , which is a 10–45 micron size 88% tungsten carbide and 12% cobalt. With a prior art Browning Model 250 thermal spray gun, the best deposit efficiency measured was 20% for thermal spraying Union Carbide 489-1 , using kerosine as a fuel.

Another advantage of the present invention is that different barrel geometries may be used as a coarse tuning for the thermal spray gun of the present invention, resulting in higher quality coatings, greater deposit efficiencies, and the ability to spray a wider range of material. Fine tuning of the thermal spray gun of the present invention to achieve optimum deposit efficiency can be accomplished by changing the combustion pressure within the combustion chamber once the thermal spray gun has been course tuned for a particular material. Having a variety of interchangeable flow nozzle barrels made of different materials, and having different geometries, provides the ability to tune a thermal spray gun for thermal spraying different coating materials.

In tests with alternative embodiments of the present invention, coarse tuning was performed by securing different flow nozzle barrels to thermal spray guns as discussed above. Fine tuning was accomplished by adjusting the flow rate of fuel and air to the combustion chamber. For example, a Browning H.V.A.F. Model 150, with which prior art flow nozzles were operated at combustion pressures ranging from 80 to 100 psi, was tuned to operate at the higher deposit efficiency of the present invention at a combustion pressure of 50 psi utilizing the above fifth prototype flow nozzle of the present invention, which was constructed from 310 stainless steel tube, having a ⅜-inch I.D. straight bore.

Another example of tuning a thermal spray gun is found in tests performed utilizing a Browning H.V.A.F.

Model 250. The Model 250 was first coarse tuned utilizing flow nozzles of the present invention made of a silicon carbide, and then fine tuned to operate at combustion chamber pressures ranging from 50–70 psi and achieve the higher deposit efficiencies of the present invention, rather than operating at between 80 and 100 psi as recommended by the manufacturer. With the preferred embodiment of the present invention, not only was Union Carbide's Material Number 489-1 thermally sprayed with good coating results, which has a particle size between 10 and 45 micron, but good coating results were also obtained thermal spraying with larger particle-sizes, such as Union Carbide Material Number 185. Material 185 is a 95% nickel alloy having particle sizes ranging from 45 to 90 microns.

Another advantage of the present invention is that it provides higher quality coatings, such as coatings having higher hardness valves. For example, in a test performed utilizing a Browning Model 250 H.A.V.F. combustion chamber and an alternative embodiment flow nozzle of the present invention to thermal spray Union Carbide Material No. 489-1 , average microhardness readings of the applied coating averaged 1,300 dph (diamond pyramid hardness) using a Vickers hardness tester and a 300 gram load. A prior art Browning Model 250 H.A.V.F. thermal spray gun applied coating of Union Carbide Material No. 489-1 hardness value are typically below 1,100 dph using a Vickers hardness tester and a 300 gram load. Additionally, cross sections of substrates coated using thermal spray guns of the present invention showed the microstructure of the coating to include good phase constituants.

Still another advantage of the present invention is the reduced costs from operating thermal spray guns of the present invention at lower combustion pressures. These lower combustion pressures for operating thermal spray guns of the present invention results in cost savings from reduced fuel costs over prior art thermal spray guns. Additionally, lower fuel usage has resulted in the temperature of targeted substrates being raised less during flame spraying, reducing cooling requirements. In some applications where targeted substrate cooling was previously required, external is no longer required. The net result is that substrate thermal fatigue effects are reduced.

Although the invention has been described with reference to a specific embodiment, and several alternative embodiments, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed:

1. A thermal spray gun for coating a substrate with a coating material transported to said substrate in a high energy flowstream, said thermal spray gun comprising in combination:

a generating means for generating said high energy flow stream within which said coating material is transported to said substrate;

a ceramic flow nozzle having an upstream end coupled to said generating means and a downstream end for directing said high energy flow stream towards said substrate, first portion of said high energy flow stream, and transferring said heat flow to a second portion of said high energy flow stream as said high energy flow stream flows towards said downstream end;

compressed gas means for delivering a gas flow to said generating means for generating said high energy flow stream; and an inlet port connected to the compressed gas means for passing said gas flow to the generating means, said inlet port being located substantially no farther downstream than said upstream end of said flow nozzle, so that said flow nozzle will be free of exposure to said gas flow to avoid any cooling of said flow nozzle by said gas flow.

2. The thermal spray gun of claim 1, wherein said flow nozzle is formed from silicon carbide.

3. The thermal spray gun of claim 1, wherein said generating means for generating said high energy flow stream comprises:

an H.V.A.F. combustion chamber for initiating a combustion reaction between a fuel and said gas flow, said gas flow comprising an oxygen source, and said combustion reaction generating a high temperature gas which is directed from said combustion chamber in a high velocity flow stream; and a means for inserting said coating material into said high velocity flow stream of said high temperature gas to form said high energy flow stream, within which said coating material is heated and propelled towards said substrate.

4. A thermal spray gun for coating a substrate with a coating material transported to said substrate in a high velocity flowstream, said thermal spray gun comprising:

a housing;

a combustion chamber located in said housing and having an upstream end and a downstream end;

an annular flow passage located between said combustion chamber and said housing;

an air inlet to said annular flow passage located at said downstream end of said combustion chamber and in communication with a source of compressed air;

a fuel injection port at said upstream end of said combustion chamber for introducing a fuel;

an air injection port at said upstream end of said combustion chamber and in communication with said annular passage for injecting said compressed air into said combustion chamber to mix with and burn said fuel for discharge as a high temperature gas flowing at high velocity;

a means for inserting said coating material into said high temperature gas to form said high velocity flow stream, within which said coating material is heated and propelled towards said substrate; and a ceramic flow nozzle having an upstream end coupled to said housing at said downstream end of said combustion chamber for directing said high velocity flow stream along a longitudinal length of said barrel towards said substrate, and said flow nozzle further for absorbing a heat flow along said longitudinal length of said flow nozzle from a first portion of said high velocity flowstream for increasing a heat content of a second portion of said high velocity flowstream passing through said flow nozzle towards said substrate, the location of said air inlet being substantially at said upstream end of said flow nozzle, and said flow nozzle being isolated from flow of said compressed air to avoid cooling of said flow nozzle.

5. The thermal spray gun of claim 4, wherein said thermal spray gun further comprises:

a barrel surrounding said flow nozzle, said barrel having an upstream end which couples to said housing, said compressed air flowing over said upstream end of said barrel which provides a barrier to prevent said flow nozzle from contact with said compressed air.

6. A flow nozzle for use with a thermal spray gun for coating a substrate with a coating material transported to said substrate within a high energy flowstream, said flow nozzle comprising:

a nozzle coupling for securing at least a portion of said flow nozzle to said thermal spray gun;

a nozzle barrel for directing said high energy flowstream from said thermal spray gun;

at least one central bore extending through said nozzle barrel for passing said high velocity flowstream therethrough;

at least one thermal member disposed within said at least one central bore for absorbing a heat flow from a first portion of said high energy flowstream flowing through said at least one central bore, and increasing a heat content of a second portion of said high energy flowstream; and wherein said thermal member is at least one ceramic insert which is releasably secured within said flow nozzle.

7. A flow nozzle for use with a thermal spray gun for coating a substrate with a coating material transported to said substrate within a high energy flowstream, said flow nozzle comprising:

a nozzle coupling for securing at least a portion of said flow nozzle to said thermal spray gun;

a nozzle barrel for directing said high energy flowstream from said thermal spray gun;

at least one central bore extending through said nozzle barrel for passing said high velocity flowstream therethrough:

at least one thermal member disposed within said at least one central bore for absorbing a heat flow from a first portion of said high energy flowstream flowing through said at least one central bore, and increasing a heat content of a second portion of said high energy flowstream; and wherein said flow nozzle includes an insert formed of silicon carbide which provides said thermal member.

8. A method for thermal spraying a substrate with a coating material said method comprising the steps of:

providing a thermal spray gun;

delivering a compressed gas flow to said thermal spray gun and generating said high energy flow stream;

providing a ceramic flow nozzle with the thermal spray gun for directing said high energy flow stream along a longitudinal length of said nozzle and towards said substrate;

absorbing a heat flow into said flow nozzle along said longitudinal length of said nozzle from a first portion of said high energy flow stream;

transferring said heat flow from said flow nozzle along said longitudinal length of said flow nozzle to a second portion of said high energy flow stream; and isolating said flow nozzle from said compressed gas flow to avoid cooling said flow nozzle with said compressed gas flow.

9. The method of claim 8, wherein said method further comprises the steps of:

injecting a plurality of combustion components into a combustion chamber, said combustion components including a fuel and said compressed gas flow;

igniting an H.V.A.F. combustion reaction for generating a high temperature pressurized gas;

directing said high temperature pressurized gas from said combustion chamber and into said flow nozzle; and inserting said coating material into said high temperature pressurized gas to form said high velocity flow stream, wherein said high temperature pressurized gas heats said coating material and transfers momentum to said coating material to propel said coating material towards said substrate at said high velocities.

10. The method of claim 8, wherein said compressed gas flow is delivered to said thermal spray gun at a point substantially no farther downstream than an upstream end of said flow nozzle.

11. The method of claim 8, wherein said compressed gas flow is delivered to said thermal spray gun substantially at an upstream end of said flow nozzle.

12. A method for thermal spraying a substrate with a coating material, said method comprising the steps of:

generating a high velocity, high energy flow stream containing said coating material;

providing a flow nozzle for directing said high energy flow stream along a longitudinal length of said nozzle and towards said substrate;

absorbing a heat flow into said flow nozzle along said longitudinal length of said nozzle from a first portion of said high energy flow stream;

transferring said heat flow from said flow nozzle along said longitudinal length of said flow nozzle to a second portion of said high energy flow stream;

providing said flow nozzle with a tapered central bore through which said high energy flow stream passes; and expanding said high energy flow stream with a diametrical expansion rate ranging between one thirty-seconds of an inch and one quarter of an inch during passage through said tapered central bore.

13. A method for thermal spraying a substrate with a coating material, said method comprising the steps of:

generating a high energy flow stream containing said coating material;

directing said high energy flow stream towards said substrate by passing said high energy flow stream through a longitudinal length of a flow nozzle;

providing a thermal barrier for retaining heat within said high energy flow stream by absorbing a heat flow into said flow nozzle along said longitudinal length of said flow nozzle from said high energy flow stream;

providing said flow nozzle with a tapered central bore through which said high energy flow stream passes; and expanding said high energy flow stream with a diametrical expansion rate ranging between one thirty-seconds of an inch and one quarter of an inch during passage through said tapered central bore.

14. A method for thermal spraying a substrate with a coating material transported in a high energy flowstream to coat said substrate, said method comprising the steps of:

injecting a plurality of combustion components into a H.V.A.F. combustion chamber of a thermal spray gun, said plurality of combustion components including a fuel and a flow of compressed air as an oxidizer;

igniting a combustion reaction for generating a high temperature pressurized gas;

directing said high temperature pressurized gas from said combustion chamber and into a high velocity flow stream;

directing said high velocity flow stream from said combustion chamber, through a longitudinal length of a ceramic flow nozzle, and towards said substrate;

inserting said coating material into said high velocity flow stream, which heats said coating material and propels said coating material towards said substrate at supersonic velocities;

absorbing a heat flow from a first portion of said high velocity flow stream into said flow nozzle along a longitudinal length of said flow nozzle;

transferring said heat flow to a second portion of said high velocity flow stream from said flow nozzle along said longitudinal length of said flow nozzle; and isolating said flow nozzle from said flow of compressed air by delivering said flow of compressed air to said thermal spray gun at a point substantially no farther downstream than an upstream end of said flow nozzle.

15. A thermal spray gun for coating a substrate with a coating material transported to said substrate in a high velocity flowstream, said thermal spray gun comprising:

a housing;

a combustion chamber located in said housing and having an upstream end and a downstream end;

an annular flow passage located between said combustion chamber and said housing;

an air inlet to said annular flow passage located at said downstream end of said combustion chamber and in communication with a source of compressed air;

a fuel injection port at said upstream end of said combustion chamber for introducing a fuel;

an air injection port at said upstream end of said combustion chamber and in communication with said annular passage for injecting said compressed air into said combustion chamber to mix with and burn said fuel for discharge as a high temperature gas flowing at high velocity;

a means for inserting said coating material into said high temperature gas to form said high velocity flow stream, within which said coating material is heated and propelled towards said substrate;

a barrel having an upstream end coupled to said housing at said downstream end of said combustion chamber; and a ceramic flow nozzle located within said barrel having an upstream end coupled to said housing at said downstream end of said combustion chamber for directing said high velocity flow stream along a longitudinal length of said flow nozzle towards said substrate, the location of said air inlet being near said upstream end of said barrel, and said flow nozzle being isolated from flow of said compressed air by said barrel to avoid cooling of said flow nozzle.

* * * * *